United States Patent [19]

Ito

[11] Patent Number: 4,796,056

[45] Date of Patent: Jan. 3, 1989

[54] ELECTROPHOTOGRAPHIC COPYING MACHINE HAVING AN AUTOMATIC PAPER SELECTING FUNCTION

[75] Inventor: Masazumi Ito, Toyohashi, Japan

[73] Assignee: Minolta Camera Kabushiki Kaisha, Osaka, Japan

[21] Appl. No.: 22,935

[22] Filed: Mar. 6, 1987

[30] Foreign Application Priority Data

Mar. 10, 1986 [JP] Japan ..... 61-53408
Mar. 10, 1986 [JP] Japan ..... 61-53409

[51] Int. Cl.[4] ..... G03G 15/00

[52] U.S. Cl. ..... 355/14 SH; 355/14 R; 355/55; 355/56

[58] Field of Search ..... 355/14 R, 14 SH, 3 SH, 355/55, 56, 8; 271/257, 258, 259, 265, 153, 154

[56] References Cited

U.S. PATENT DOCUMENTS

| | | | |
|---|---|---|---|
| 3,684,373 | 8/1972 | Berge et al. | 355/111 |
| 3,689,143 | 9/1972 | Case et al. | 355/8 X |
| 4,054,380 | 10/1977 | Donohue et al. . | |
| 4,108,427 | 8/1978 | Komori et al. | 271/9 |
| 4,190,246 | 2/1980 | Sasuga | 355/3 SH X |
| 4,265,440 | 5/1981 | Shibazaki et al. . | |
| 4,277,163 | 7/1981 | Ikesue et al. | 355/14 R |
| 4,338,020 | 7/1982 | Yukawa et al. | 355/14 SH X |
| 4,440,487 | 4/1984 | Miura | 355/14 R |
| 4,455,081 | 6/1984 | Yoshimura et al. | 355/14 SH |
| 4,505,579 | 3/1985 | Furuichi . | |
| 4,511,246 | 4/1985 | Nishiyama | 355/14 SH X |
| 4,575,227 | 3/1986 | Ito et al. . | |
| 4,585,332 | 4/1986 | Stenoy | 355/14 SH X |
| 4,607,946 | 8/1986 | Uchiyama et al. | 355/14 SH X |
| 4,620,782 | 11/1986 | Kuraneto et al. | 355/14 SH |
| 4,647,188 | 3/1987 | Komiya et al. | 355/14 R X |
| 4,669,858 | 6/1987 | Ito et al. | 355/55 X |
| 4,724,462 | 2/1988 | Yamasaki et al. | 355/14 R |
| 4,740,810 | 4/1988 | Ito | 355/55 X |

FOREIGN PATENT DOCUMENTS

| | | | |
|---|---|---|---|
| 0148736 | 9/1982 | Japan | 355/56 |
| 0208760 | 12/1983 | Japan | 355/14 SH |
| 0147358 | 8/1984 | Japan | 355/56 |
| 0059332 | 3/1986 | Japan | 355/56 |
| 2162330 | 1/1986 | United Kingdom | 355/56 |

OTHER PUBLICATIONS

IBM Technical Disclosure Bulletin, vol. 17, No. 9, Feb. 1975, "Copy Sheet Size Selection," by J. L. Bacon.

*Primary Examiner*—A. T. Grimley
*Assistant Examiner*—John G. Smith
*Attorney, Agent, or Firm*—Burns, Doane, Swecker & Mathis

[57] ABSTRACT

A main body 1 of an electrophotographic copying machine has feed openings to which a plurality of cassettes 20 and 21 for containing paper of different sizes are attached. The sizes of paper and setting directions of paper are detected by microswitches 410 to 413 and 414 to 417. A document feeding unit 300 is placed on the main body 1 and while a document is fed to an exposure position by means of the document feeding unit 300, the size of the document is detected by a sensor 310. In an automatic paper selection mode, even if paper does not exist in a selected feed opening, it is determined whether paper suited to be used, taking into account the size of the document and the magnification, exists in any other feed openings. If it exists in any one of the feed openings, this opening is selected. If it does not exist in any of the feed openings, copy operation is forbidden and a microprocessor 201 of the main body 1 is programmed to display the forbidden state. This forbidden state can be cancelled by changing the magnification or by supplying paper.

6 Claims, 19 Drawing Sheets

ELECTROPHOTOGRAPHIC COPYING MACHINE HAVING AN AUTOMATIC PAPER SELECTING FUNCTION

BACKGROUND OF THE INVENTION

1. Field of the Invention

The present invention relates to an electrophotographic copying machine having an automatic paper selecting function and particularly to an electrophotographic copying machine having an improved efficiency of operation in an automatic paper selection mode.

2. Description of the Prior Art

In the prior art, there is known an electrophotographic copying machine having an automatic paper selection mode, which comprises a plurality of paper feed portions for containing paper of different sizes and which automatically selects a paper feed portion containing paper of a size corresponding to a size of a document to be copied, thereby to perform a copy operation using the paper in the selected paper feed portion.

In such an electrophotographic copying machine, if the automatic paper selection mode is selected and a print key is pressed, the size of the document is detected and then a paper feed portion containing paper suited for the detected size of the document is automatically selected, whereby the copy operation is performed.

Such an automatic paper selection mode is disclosed for example in the below indicated documents.

The U.S. Pat. No. 3,684,373 discloses a technique in which a size of a document fed is detected by a switch and paper suited for the detected size is used for a copy operation; the U.S. Pat. No. 3,689,143 discloses a technique in which a size of a document fed is detected by sensors and a paper feed portion containing paper suited for the detected size and a magnification are selected; the U.S. Pat. No. 4,455,081 discloses a technique in which a size of a document fed is detected by switches and a paper feed portion containing paper suited for the detected size is selected; and "COPY SIZE SELECTION" by J. L. Bacon in IBM Technical Disclosure Bulletin Vol. 17 No. 9, February 1975, pp. 2690–2690A discloses a technique in which a size of a document fed is detected by a sensor and clocks and a paper feed portion containing paper suited for the detected size is selected for copy operation.

There is known another technique in which a magnification is automatically adjusted by evaluatnng the optimum magnification based on a size of a document and a size of copy paper, which is disclosed for example in the U.S. Pat. No. 4,277,163.

Generally in an electrophotographic copying machine, if paper does not exist in a selected paper feed portion, control is effected to forbid input by a print key irrespective of whether an automatic paper selection mode is adopted or not. For example, the U.S. Pat. No. 4,108,427 discloses that if paper does not exist in a selected paper feed portion, copy operation is forbidden to cause a display device to indicate the need for supply of paper.

Consequently, in a copying machine having such an automatic paper selection mode, input by a print key is forbidden when paper does not exist in a presently selected paper feed portion and, as a result, a copy operation can not be started even if paper of a suitable size is contained in other paper feed portions, which considerably reduces efficiency in copy operation.

SUMMARY OF THE INVENTION

Therefore, a primary object of the present invention is to provide an electrophotographic copying machine having an improved efficiency in copy operation in an automatic paper selection mode.

Briefly stated, the present invention is an electrophotographic copying machine comprising: image forming means for forming an image of a document; a plurality of paper feed portions capable of containing paper of different sizes; means for detecting a size of paper in each paper feed portion; means for detecting existence of paper in each paper feed portion; manual selection means for manually selecting any of the plurality of paper feed portions; means for detecting a size of a document; automatic selection means for automatically selecting a paper feed portion containing paper of a size suited for the detected size of the document; automatic mode selection means for selecting an automatic mode for performing copy operation using the automatic selection means; instruction input means for inputting a start instruction for starting operation of the image forming means; input forbidding means for forbidding input of the start instruction when paper does not exist in the paper feed portion selected by the manual selection means; and cancel means for cancelling the forbidden state of the input forbidding means when the automatic mode is selected.

According to another aspect of the present invention, an electrophotographic copying machine further comprises means for forbidding a copy operation when paper of a size suited for the size of the document does not exist in any of the paper feed portions in the automatic mode.

According to a further aspect of the present invention, an electrophotographic copying machine comprises: image forming means for forming an image of a document with a variable magnification; a plurality of paper feed portions capable of containing paper of different sizes; instruction input means for inputting a start instruction for starting operation of the image forming means; means for detecting a size of paper in each paper feed portion; document size detecting means for detecting a size of a document in response to the input of the start instruction by the instruction input means; means for selecting a desired magnification; means for automatically selecting a paper feed portion containing paper of the most suitable size for copying, with the selected magnification, the document of the size detected by the document size detecting means; means for evaluating the minimum copy size based on the selected magnification and the minimum document size which can be detected by the document size detecting means; and means for forbidding input of the start instruction when paper of a size larger than the minimum copy size does not exist in any of the paper feed portions.

According to a still further aspect of the present invention, an electrophotographic copying machine further comprises means for displaying a state in which input of the start instruction is forbidden.

According to a still further aspect of the present invention, the state in which input of the start instruction is forbidden is cancelled by change of the magnification or supply of paper.

According to a still further aspect of the present invention, an electrophotographic copying machine comprises: image forming means for forming an image of a document with a variable magnification; a plurality of paper feed portions capable of containing paper of different sizes; means for detecting a size of paper in each paper feed portion; means for detecting existence of paper in each paper feed portion; manual selection means for manually selecting any of the plurality of paper feed portions; means for manually selecting a desired magnification; document size detecting means for detecting a size of a document; automatic selection means for automatically selecting a paper feed portion containing paper of a size suited for the detected size of the document and the selected magnification; automatic mode selection means for selecting an automatic mode for performing copy operation using the automatic selection means; instruction input means for inputting a start instruction for starting operation of the image forming means; input forbidding means for forbidding input of the operation start instruction when paper does not exist in the paper feed portion selected by the manual selection means; means for evaluating the minimum copy size based on the selected magnification and the minimum document size which can be detected by the document size detecting means; and means for cancelling the forbidden state of the input forbidding means when the automatic mode is selected and paper of a size larger than the minimum copy size exists in any of the paper feed portions.

According to a still further aspect of the present invention, the image forming means comprises an automatic document feeder which feeds a document and sets it at an exposure position and moves it therefrom after exposure.

According to a still further aspect of the present invention, the document size detecting means detects a size of a document when the automatic document feeder feeds the document to the exposure position.

According to a still further aspect of the present invention, the automatic document feeder starts feeding a document in response to input of the start instruction by the instruction input means.

A principal advantage of the present invention is that even if paper does not exist in a selected paper feed portion, starting of the copy operation is permitted in the automatic paper selection mode when any of the other paper feed portions contains paper which can be selected in this mode.

Another advantage of the present invention is that a paper feed portion containing paper of the most suitable size is searched for out of the paper feed portions other than the selected paper feed portion so that the paper feed portion containing paper of the most suitable size can be selected.

Another advantage of the present invention is that if paper of a suitable size does not exist in any of the paper feed portions, such nonexistence of paper is indicated before the start of a copy operation so that paper of a suitable size can be supplied or the magnification can be changed to a suitable value before the start.

These objects and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described in the below indicated order with reference to the attached drawings.

a. Construction of a Copying Machine
b. Operation Panel
c. Construction of a Control Portion of the Copying Machine
d. Operation of a Main Body of the Copying Machine
  (d-1) Main Routine
  (d-2) Paper Selection
  (d-3) Empty Display Control
  (d-4) Copy Operation
  (d-5) Automatic Paper Selection
e. Operation of an Automatic Document Feeder Processing in an automatic paper selection mode in which a characteristic feature of the present invention resides will be specifically described in (d-3), the first half of (d-4) and (d-5).

(a) Construction of a Copying Machine

Figure 1:
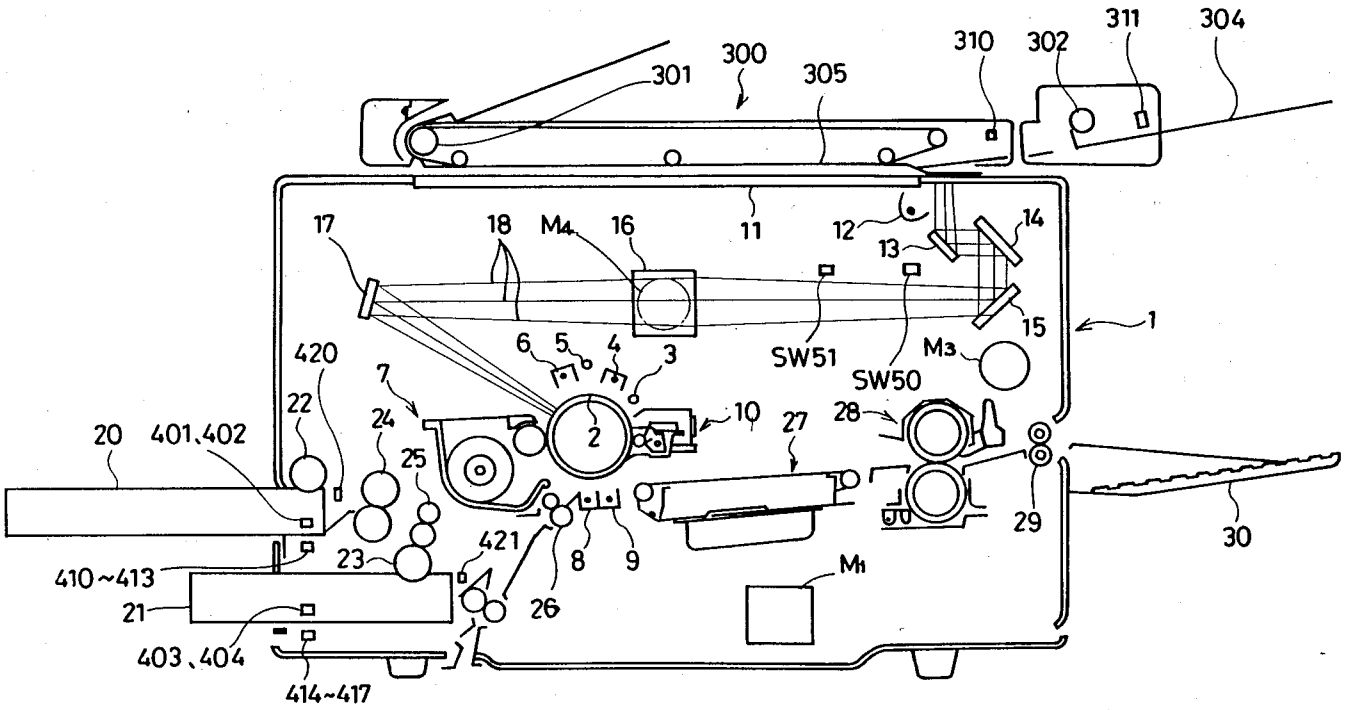
FIG. 1 is a schematic sectional view of an electrophotographic copying machine according to an embodiment of the present invention.

FIG. 1 is a schematic sectional view of an electrophotographic copying machine of an embodiment of the present invention.

Referring first to FIG. 1, construction of the electrophotographic copying machine of this embodiment will be described.

A copying mechanism of a main body 1 of the electrophotographic copying machine shown in FIG. 1 is same as that of a conventional electrophotographic copying machine. A photoreceptor drum 2 rotatable counterclockwise is provided in a central portion of the main body 1 and, around this photoreceptor drum 2, there are provided a main eraser lamp 3, an auxiliary electrification charger 4, an auxiliary eraser lamp 5, a main electrification charger 6, a development device 7, a transfer charger 8, a transfer paper separation charger 9, and a cleaner 10 of a blade type. The photoreceptor drum 2 has a surface on which a photoreceptor such as selenium is provided. For each copy operation, this photoreceptor drum 2 receives light from the eraser lamps 3 and 5 and is electrified by the electrification chargers 4 and 6 and then it is subjected to an imaging exposure from an optical system to be described below. A motor M1 drives the photoreceptor drum 2 and other related components.

The optical system is provided under a document glass table 11 so as to scan an image of a document. The optical system comprises a light source 12, a first mirror 13, a second mirror 14, a third mirror 15, a projection lens 16 and a fourth mirror 17. The image of the document attains the photoreceptor drum 2 through the respective mirrors 13, 14, 15 and 17 as shown by the lines 18. A position switch SW50 is provided to detect whether the optical system is located at a prescribed position at the time of scanning. A magnification is set by moving the projection lens 16 along the direction of the optical axis by means of a motor M4. A motor M3 drives the optical system. If the magnification is n, the light source 12 and the first mirror 13 are moved to the left at a speed (v/n) by the motor M3 corresponding to rotation of the photoreceptor drum 2 at a rotation speed v (which is constant irrespective of whether an equal-scale magnification or a variable magnification is selected) and, at the same time, the second mirror 14 and the third mirror 15 are moved to the left at a speed (v/2n). As a result of those movements, the image is exposed onto the photoreceptor drum 2 through the fourth mirror 17 in a slit manner.

Automatic paper feed cassettes 20 and 21 are provided in an upper feed opening and a lower feed opening, respectively, on the left side of the main body 1 of the copying machine. Paper in the automatic pape feed cassette 20 or that in the automatic paper feed cassette 21 is selectively fed into the main body 1 by means of a paper feed roller 22 or 23 and passes through transport rollers 24 and 25 to attain a timing roller 26 in a pressed state, where it is temporarily stopped.

At the time of transfer operation, the paper fed by the timing roller 26 is closely attached to the photoreceptor drum 2 in a transfer portion and a toner image is transferred onto the paper by corona discharge of the transfer charger 8. Then, the paper is separated from the photoreceptor drum 2 by corona discharge of the separation charger 9 as well as by the elasticity of the paper itself. Subsequently, the paper is drawn onto a transport belt 27 comprising air suction means, not shown, so that it is moved rightward by clockwise rotation of this belt 27. When the paper passes through a fixing device 28, the toner image is subjected to thermal fusing. Then, the paper passes through discharge rollers 29 so as to be discharged onto a tray 30 outside the main body 1.

Paper type (color) detection switches 401 and 402, and paper type (color) detection switches 403 and 404 are microswitches for detecting a type (color) of paper in the cassette 20 and that in the cassette 21, respectively. Paper size detection switches 410 to 413 and 414 to 417 are microswitches provided in the upper and lower feed openings. Those detection switches 410 to 413 and 414 to 417 detect sizes of paper in the cassettes 20 and 21, respectively, and those switches determine whether paper is set lengthwise, namely in a direction in which its longer sides are parallel to the paper feeding direction, or widthwise, namely in a direction in which its longer sides are perpendicular to the paper feeding direction. Sizes of paper which can be copied, namely, sizes of paper which can be set in the respective paper feed portions are for example A3, A4, A5, B4 and B5 sizes and as for the A4 and B5 sizes, lengthwise and widthwise setting directions can be selected. Switches 420 and 421 detect attachment or detachment of the cassettes 20 and 21, respectively, to or from the main body 1 and by this detection, existence or nonexistence of paper in the respective paper feed openings can be indirectly detected. A size and a setting direction of paper are detected by four-bit codes according to combination of on/off states of the switches 410 to 413 and 414 to 417 so as to be stored in a RAM contained in the microprocessor 201 of a control circuit (to be described afterwards in connection with FIG. 5). An example of a code table based on combination of the switches 410 to 413 is shown in the following table. In this table, "0" represents an on state of a switch and "1" represents an off state of a switch. If all of the switches are turned off, it is determined that the cassette 20 is not attached to the paper feed portion, namely, that paper does not exist in the paper feed portion.

TABLE 1

| Decimal | Binary code | | | | |
|---|---|---|---|---|---|
| Code | SW413 | SW412 | SW411 | SW410 | Paper Size |
| 0 | 0 | 0 | 0 | 0 | |
| 1 | 0 | 0 | 0 | 1 | |
| 2 | 0 | 0 | 1 | 0 | |
| 3 | 0 | 0 | 1 | 1 | |
| 4 | 0 | 1 | 0 | 0 | B5 lengthwise |
| 5 | 0 | 1 | 0 | 1 | A4 lengthwise |
| 6 | 0 | 1 | 1 | 0 | B4 lengthwise |
| 7 | 0 | 1 | 1 | 1 | A3 lengthwise |
| 8 | 1 | 0 | 0 | 0 | |
| 9 | 1 | 0 | 0 | 1 | |
| 10 | 1 | 0 | 1 | 0 | B5 widthwise |
| 11 | 1 | 0 | 1 | 1 | A4 widthwise |
| 12 | 1 | 1 | 0 | 0 | |
| 13 | 1 | 1 | 0 | 1 | |
| 14 | 1 | 1 | 1 | 0 | |
| 15 | 1 | 1 | 1 | 1 | no cassette |

Figure 2A:
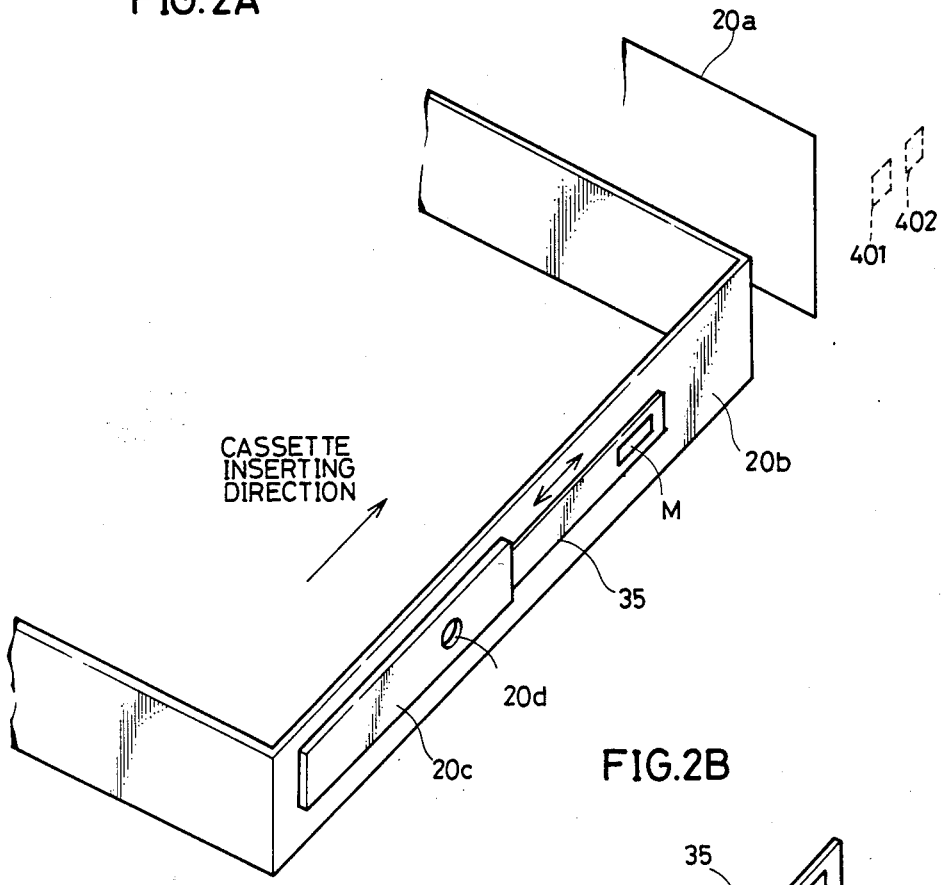
FIGS. 2A and 2B are perspective views showing a mechanism for selecting a color of paper set in a cassette.
Figure 2B:
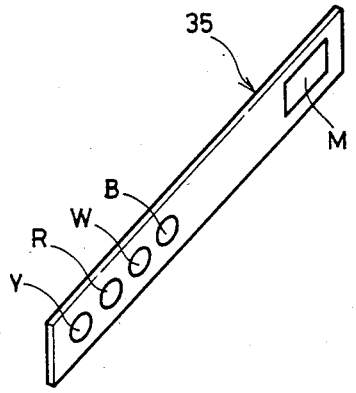

FIGS. 2A and 2B are perspective views showing a mechanism for selecting a type (color) of paper set in the cassette 20.

Referring to FIGS. 2A and 2B, detection by the sensors 401 and 402 shown in FIG. 1 as to a type (color) of paper set in the cassette 20 will be described. As shown in FIG. 2A, an indication plate 35 having one end provided with a magnet M is provided on a side face 20*b* of the cassette 20. On the other end portion of the indication plate 35, four colors, i.e. black B, white W, red R and yellow Y are indicated as shown in FIG. 2B. This color indicating portion is inserted in a space formed between the side face 20*b* and a guide plate 20*c* so taat the indication plate 35 is movable in this space along a cassette inserting direction. The position of the magnet M provided on the indication plate 35 is changed for each color and a color signal is obtained by combination of on/off states of the sensors 401 and 402. The guide plate 20*c* has a window 20*d* and a color selected by moving the indication plate 35 can be visually confirmed through the window 20*d*.

Referring again to FIG. 1, there is shown a document feeding unit 300 of an automatic document feeder placed on the main body 1 of the copying machine. In this document feeding unit 300, a sensor 310 determines whether a document is fed or not and a sensor 311 determines whether a document exists on a document tray 304.

A motor 301 rotates a document transport belt 305 of the document feeding unit 300 and a motor 302 delivers a document from the document tray 304.

In order to start copy operation, a start key of an operation panel to be described below in (b) is pressed. First of all, an automatic document feeding mechanism is operated. The document feeding unit 300 feeds a document on the document tray 304 so that the document is moved to a prescribed position on the document glass table 11 on the upper surface of the main body 1 by means of the belt 305. During the movement, the sensor 310 determines a size of the document.

When the document attains the prescribed position and the belt stops, the main body 1 of the copying machine starts operation. A mode of this operation is set when the automatic document feeder is connected to the main body and a document is placed on the document tray 304. The document feeding unit 300 can be opened like a document cover. When the document feeding unit 300 is opened and a document is manually placed on the document glass table, an automatic document feeding mode is cancelled and copy operation in a standard mode is performed. When the automatic document feeding mode is cancelled, a document size can not be detected and if an automatic paper selection mode is selected, this mode is also cancelled.

(b) Operation Panel

Figure 3:
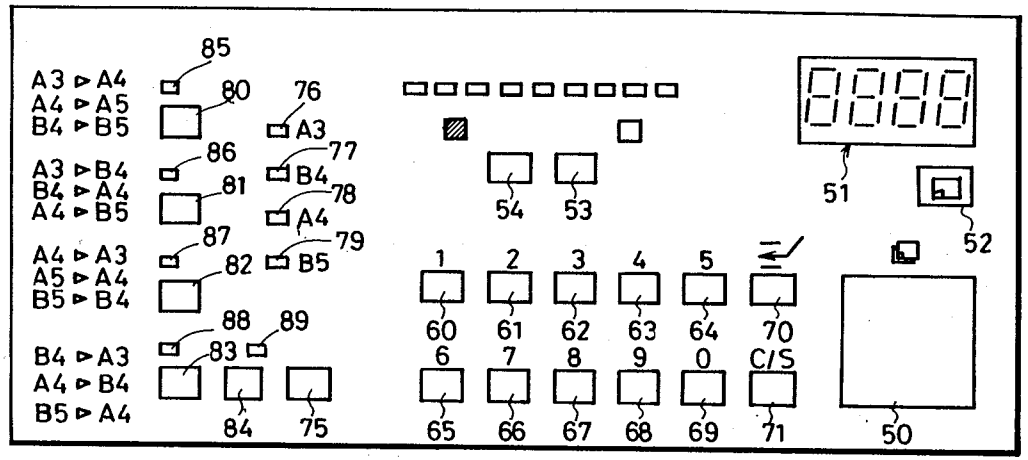
FIG. 3 is a plan view of an operation panel of a copying machine

FIG. 3 is a plan view showing an operation panel of the copying machine shown in FIG. 1. This operation panel comprises keys and display elements denoted by the following reference numerals.

Figure 4:
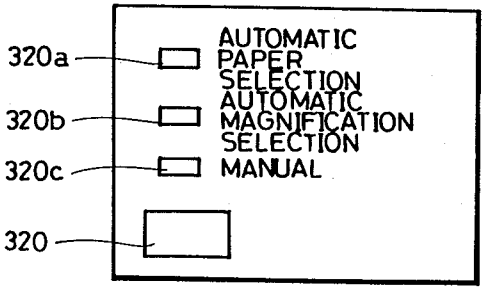
FIG. 4 is view of an operation panel of an automatic document feeder.

50: print button for starting copy operation
51: numerical display of light emitting diode (LED) for displaying the number of copies
52: empty display
53: exposure degree increment key
54: exposure degree decrement key
60 to 69: ten keys for setting the number of copies and other data
70: interruption key for interrupting copying operation and allowing another copying operation
71: key serving as a stop key for stopping copy operation in a multiple mode and as a clear key for clearing stored numerical data
75: paper selection key
76 to 79: A3, B4, A4 and B5 selection displays
80: scale-down selection key from A3 to A4
81: scale-down selection key from A3 to B4
82: scale-up selection key from A4 to A3
83: scale-up selection key from B4 to A3
84: equal scale magnification selection key
85 to 88: selection displays of the selection keys 80 to 83
89: equal scale magnification selection display FIG. 4 is a plan view showing an automatic document feeding operation panel provided on the document feeding unit 300.

This operation panel comprises a selection key 320. LED display elements 320*a*, 320*b* and 320*c* indicate selection of an automatic paper selection mode, an automatic magnification selection mode and a manual mode, respectively. Each time the selection key 320 is pressed, a mode to be selected is changed and a display element which emits light is changed.

(c) Construction of a Control Portion of the Copying Machine

Figure 5:
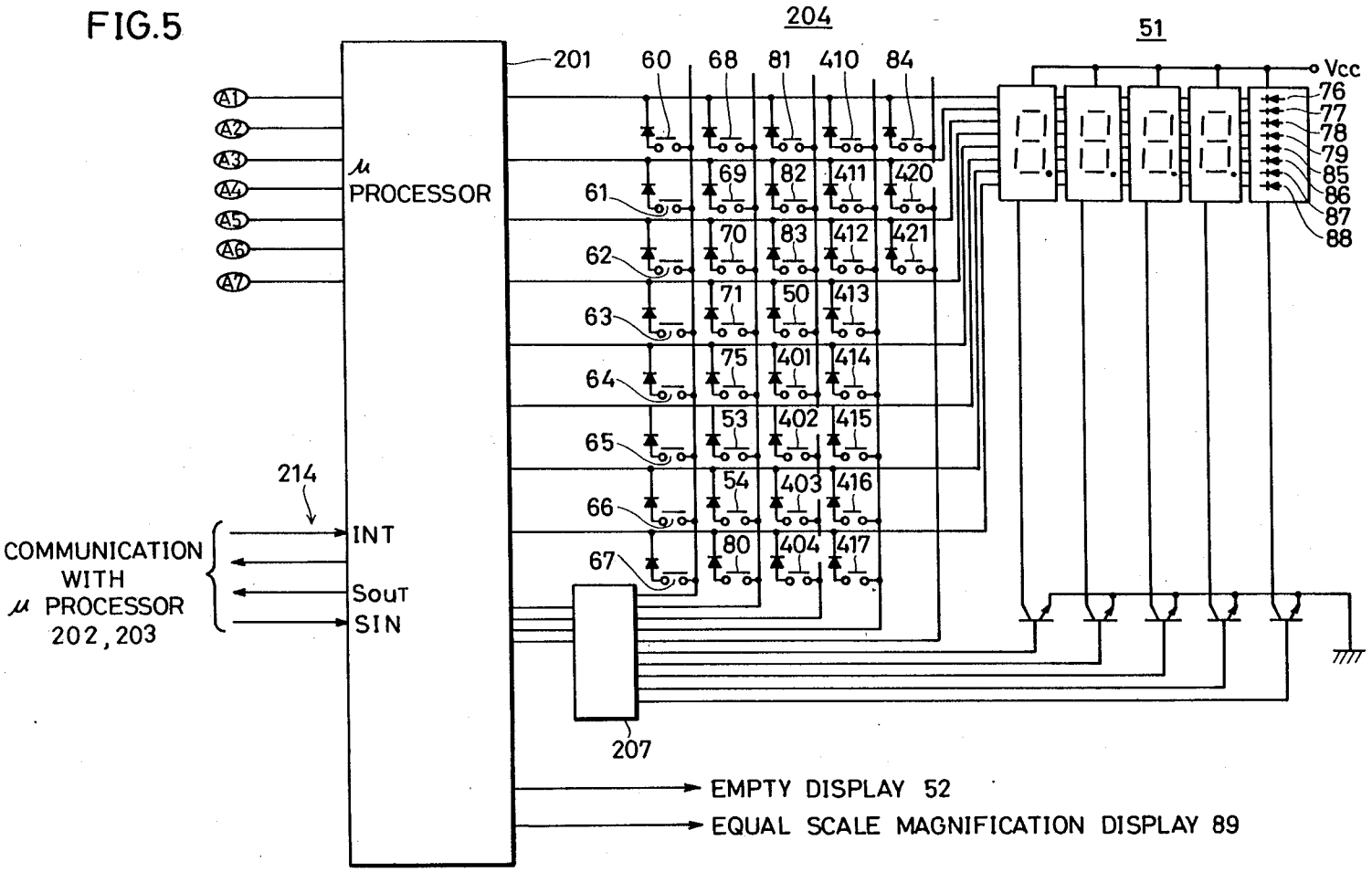
FIG. 5 is a circuit diagram showing an input and output relation with respect to a microprocessor 201 for controlling a main body of a copying machine.

FIG. 5 is a circuit diagram showing an input and output relation with respect to a microprocessor 201 for controlling the main body 1 of the copying machine. Output terminals of the microprocessor 201 provide various signals as shown (such as signals for a main motor (A1), a development motor (A2), a timing roller clutch (A3), an upper paper feed clutch (A4), a lower paper feed clutch (A5), an electrification charger (A6), a transfer charger (A7) etc.) while input terminals are connected with a switch matrix 204 comprising various sensors and keys (denoted by the reference numerals 50, 52, 53, 60 to 71, 80 to 84, 401 to 404, 410 to 417, 420 and 421). Output terminals of the microprocessor 201 are connected with the four-digit numerical display 51 and the LED display matrix (denoted by the reference numerals 76 to 79 and 85 to 88) so as to be driven by the microprocessor 201 through a decoder 207. The empty display 52 and the equal scale magnification display 89 are also connected to the output terminals. A bus 214 serves as communication lines connected to other microprocessors 202 and 203 to be described afterwards.

Figure 6:
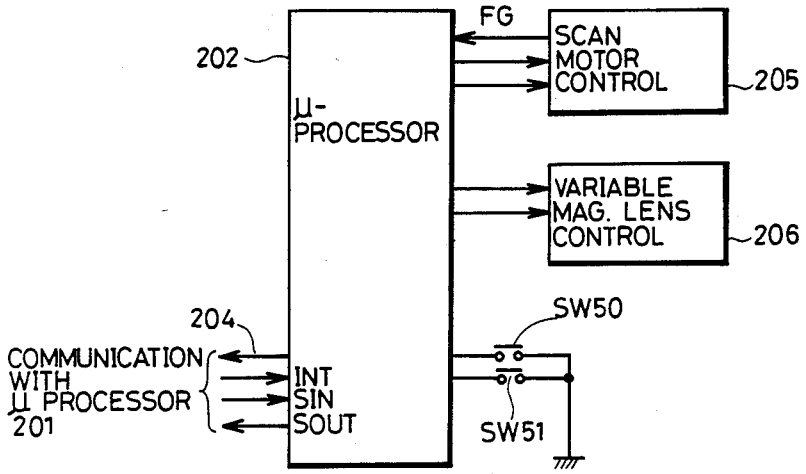
FIG. 6 is a circuit diagram showing an input and output relation, with respect to a microprocessor 202 for controlling an optical system of a copying machine.

FIG. 6 is a circuit diagram showing an input and output relation with respect to a microprocessor 202 for controlling the optical system of the copying machine. Input/output ports of the microprocessor 202 are connected with a scanning motor control circuit 205 for controlling the scanning motor M3 and a variable magnification lens control circuit 206 for controlling the motor M4 for moving the projection lens 16. The input/output ports receive a signal from the prescribed position detection switch SW50 of the optical system and also receive a signal from the switch SW51 for generating a timing signal to rotate the timing roller 26 at the time of copy operation with an equal scale magnification. The microprocessor 202 communicates with the microprocessor 201 through the bus 214 as described previously.

Figure 7:
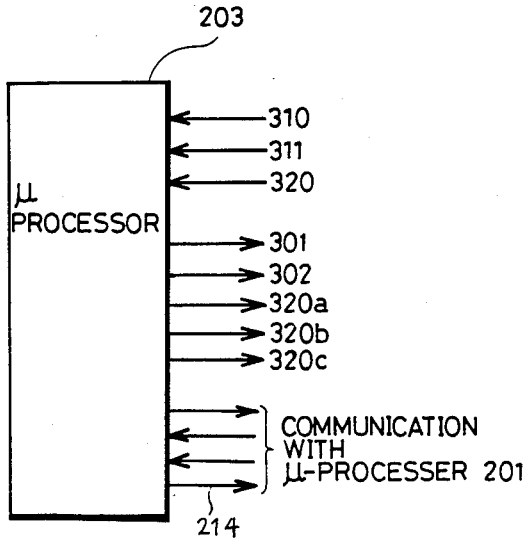
FIG. 7 is a circuit diagram showing an input and output relation with respect to a microprocessor 203 for controlling an automatic document feeder.

FIG. 7 is a circuit diagram showing an input and output relation with respect to a microprocessor 203 for controlling the document feeding unit 300. The microprocessor 203 provides signals to the transport belt motor 301 and the paper feed motor 302 and receives signals from the document feed sensor 310 and the document detection sensor 311. The microprocessor 203 is connected with the selection key 320 and the display elements 320*a* to 320*c*. As described previously, the microprocessor 203 communicates with the microprocessor 201 through the bus 214.

(d) Operation of the Main Body of the Copying Machine

An outline of a program of the microprocessor 201 for controlling the main body 1 of the copying machine will be described in the following.

(d-1) Main Routine

Figure 8:
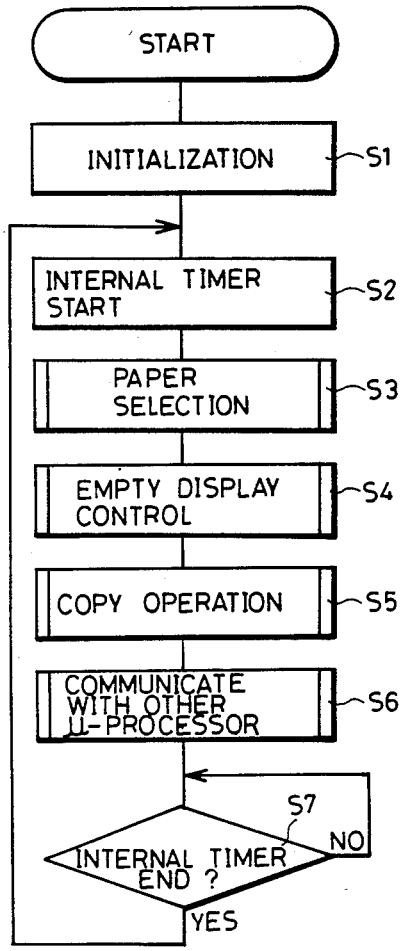
FIG. 8 is a flow chart of a main routine of a program for controlling a main body of a copying machine.

FIG. 8 shows an outline flow chart of the microprocessor 201. When the microprocessor 201 is reset to start the program, initialization is performed. More specifically, the microprocessor 201 is initialized to clear the RAM and to set the registers to initial values, and the copying machine is set to an initial mode (in the step S1).

Then, an internal timer contained in the microprocessor 201 and having a value set by the initialization starts measurement (in the step S2). Subsequently, various processing operations such as paper selection (in the step S3), empty display control (in the step S4) and copy operation (in the step S5) are successively performed. Then, data is communicated with the microprocessors 202 and 203 (in the step S6).

When all the procedures of the subroutines are completed, the microprocessor 201 waits for an end of the measurement of the initially set internal timer (in the step S7) to bring one routine to an end. Then, the program returns to the step S2. Using the time period of one routine as a unit length, various timers in the subroutines perform measurement. (A count value of each timer corresponds to the number of occurrences of one routine, by which an end of measurement of each timer is determined.)

(d-2) Paper Selection

Figure 9:
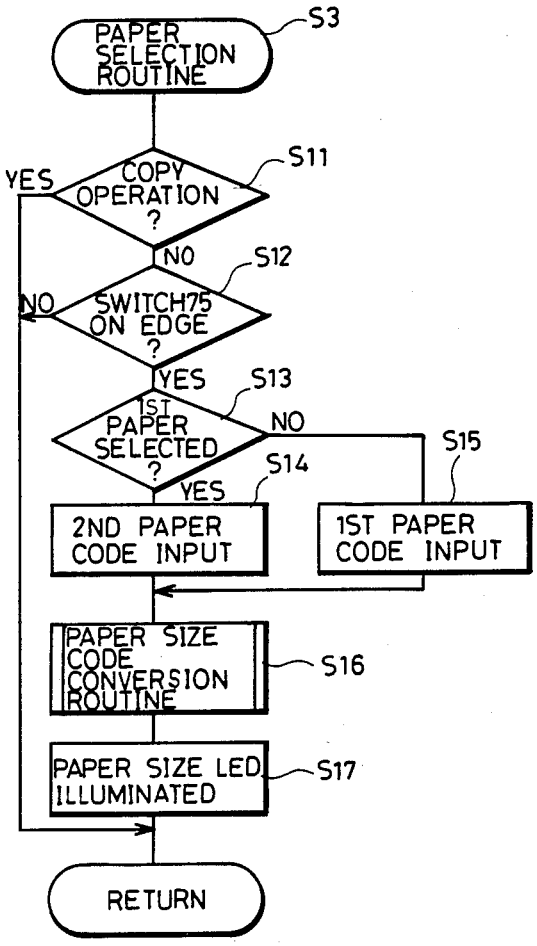
FIG. 9 is a flow chart of a subroutine of paper selection.

FIG. 9 is a flow chart of the paper selection routine (in the step S3).

When a copy operation is being done (in the step S11), control returns to the main routine. If the paper selection switch 75 is turned on when the first paper is selected at present, the second paper is newly selected (in the step S14). If the switch 75 is turned on when the second paper is selected at present, the first paper is newly selected (in the step S15). Thus, a paper size code of the paper is inputted. Then, a paper size code conversion routine (to be described indetail below) is called (in the step S16) so that one of the LED display elements 76 to 79 corresponding to the set paper size is illuminated (in the step S17).

Figure 10:
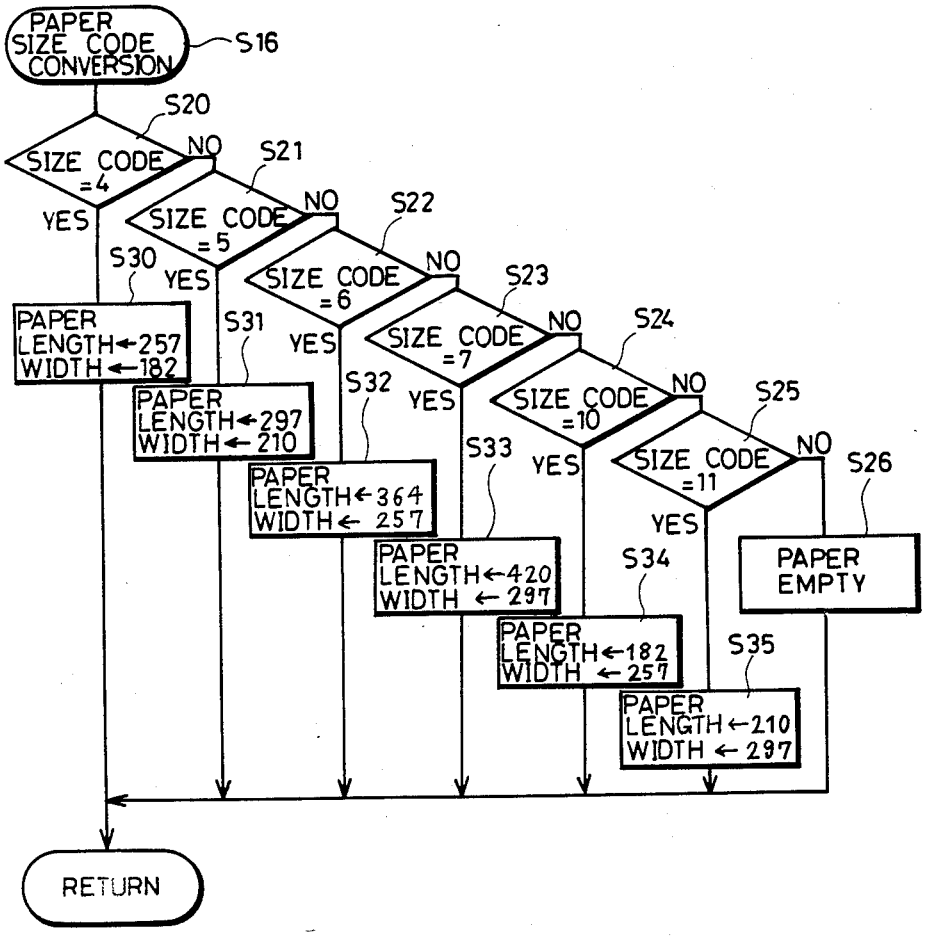
FIG. 10 is a flow chart of a subroutine for conversion of a paper size code.

FIG. 10 shows the paper size code conversion routine. The paper sizes are coded as indicated above in Table 1. If the inputted paper size code is "4" (in the step S20), this means that paper of the B5 size is set lengthwise, namely, the paper is set with its longer sides being parallel to the feeding direction, and accordingly a paper length of 257 mm and a paper width of 182 mm are stored in memory (in the step S30).

Similarly, if a paper size code is "5" (in the step S21), it is determined that paper of the A4 size is set lengthwise; if it is "6" (in the step S22), it is determined that paper of the B4 size is set lengthwise; if it is "7" (in the step S23), it is determined that paper of the A3 size is set lengthwise; if it is "10" (in the step S24), it is determined that paper of the B5 size is set widthwise, namely, the paper is set with its longer sides being perpendicular to the feeding direction and if it is "11" (in the step S25), it is determined that paper of the A4 size is set widthwise, whereby the paper length and the paper width are stored in memory (in the steps S30 to S35). If the paper size code is not any of the above indicated numerals, it is determined that paper does not exist (in the step S26).

(d-3) Empty Display Control

Figure 11A:
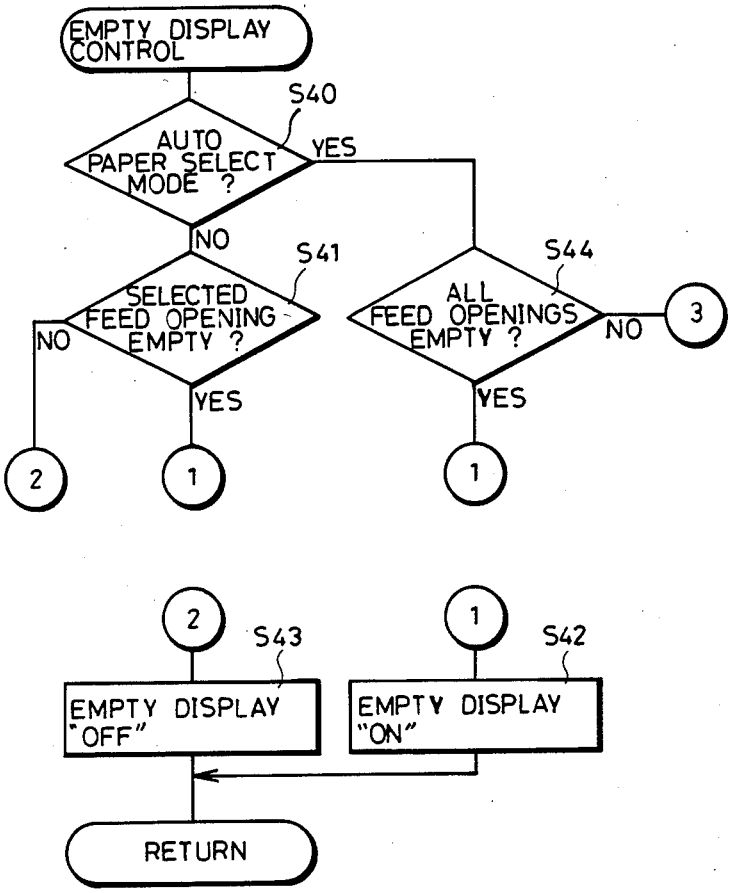
FIGS. 11A and 11B are flow charts showing a first example of a subroutine of empty display control.
Figure 11B:
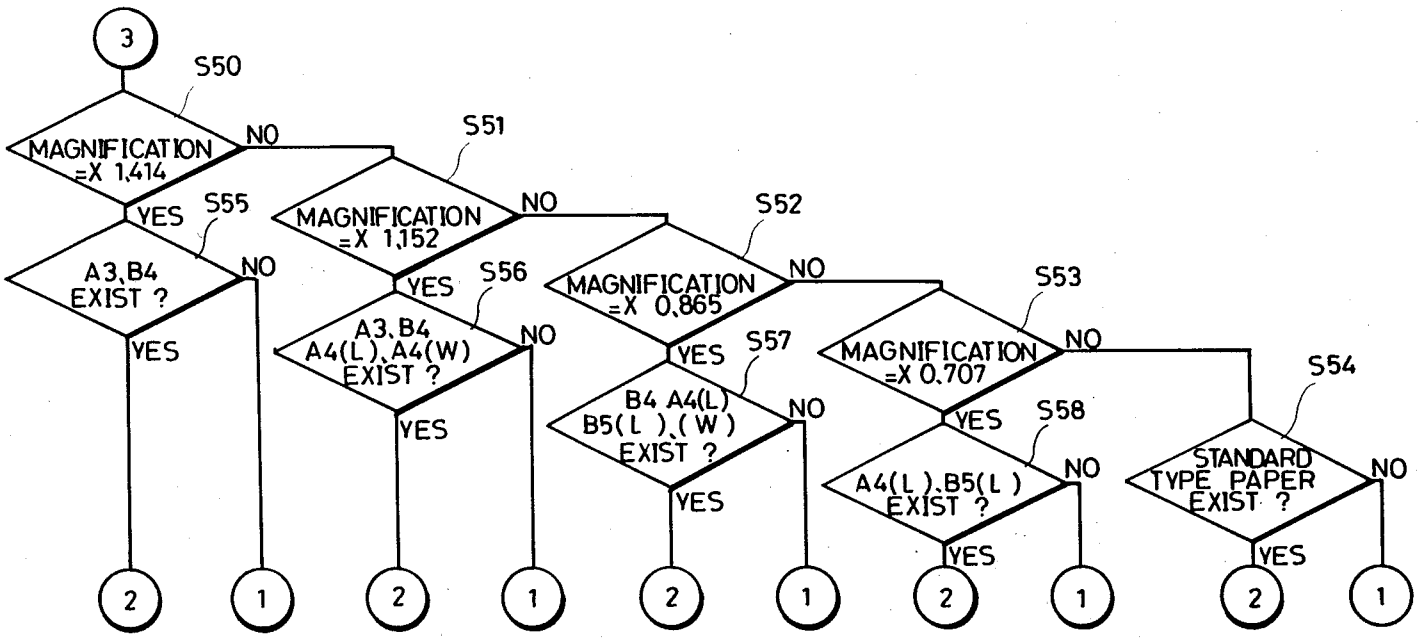

FIGS. 11A and 11B are flow charts of a subroutine of empty display control.

First, it is determined whether the automatic paper selection mode is set or not (in the step S40). If the automatic paper selection mode is not set, the empty display is illuminated (in the step S42) if the selected feed opening is empty of paper (in the step S41), and the empty display is not illuminated (in the step S43) if the selected feed opening is not empty.

If the automatic paper selection mode is set (in the step S40), it is determined whether all th feed openings of the copying machine are empty (in the step S44). If they are all empty, the empty display is illuminated (in the step S42). If all of them are not empty, it is determined based on the document size and the magnification whether paper allowed to be used (as shown afterwards in Table 2) is set in any feed opening or not. More specifically, if the magnification is 1.414 (in the step S50), it is determined whether paper of the standard type having the A3 or B4 size exists in any of the feed openings (in the step S55). If the above indicated paper exists, the empty display is not illuminated (in the step S43). If the above indicated paper does not exist in any of the feed openings, the empty display is illuminated (in the step S42). In other words, if the magnification is 1.414, any paper other than paper of the A3 or B4 size is not allowed to be selected with respect to any size of a document (even if the document having the minimum B5 size is set lengthwise), and consequently if any paper other than the A3 or B4 size is already set in the copying machine, this does not have any meaning.

Similarly, if the magnification is 1.152 (in the step S52), 0.865 (in the step S53), 0.707 (in the step S53), or 1.000 (in the step S54), the empty display is illuminated or not illuminated (in the step S42 or S43) dependent on whether paper allowed to be selected is set in the copying machine (in the steps S56 to S58).

Figure 11C:
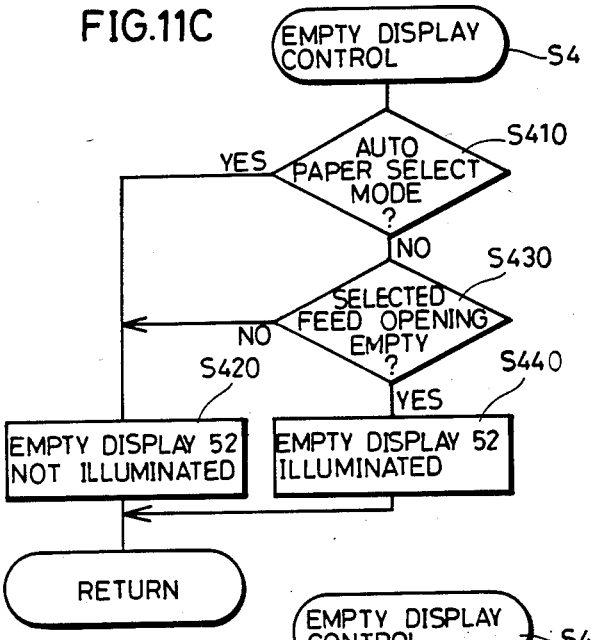
FIG. 11C is a flow chart showing a second example of a subroutine of empty display control.

FIG. 11C is a flow chart showing a second example of the empty display control routine (in the step S4).

In the automatic paper selection mode (in the step S410), the empty display 52 is not illuminated (in the step S420). If the automatic paper selection mode is not set, the empty display 52 is illuminated (in the step S440) if the selected feed opening is empty of paper (in the step S430), and the empty display 52 is not illuminated (in the step S420) if the selected feed opening is not empty.

Figure 11D:
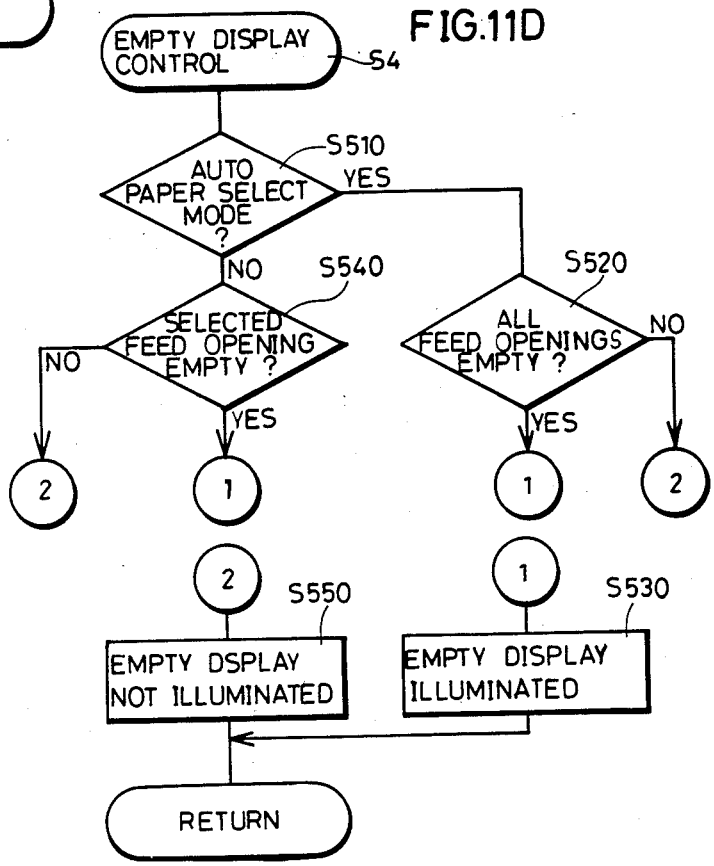
FIG. 11D is a flow chart of a third example of a subroutine of empty display control.

FIG. 11D is a flow chart showing a third example of the empty display control routine (in the step S4).

In the automatic paper selection mode (in the step S510), it is determined (in the step S520) whether all the feed openings of the copying machine are empty of paper. If they are all empty, the empty display is illuminated (in the step S530). If all of them are not empty, the empty display is not illuminated (in the step S550). If the automatic paper selection mode is not selected (in the step S510), the empty display is illuminated (in the step S530) if the selected feed opening is empty of paper (in the step S540), and the empty display is not illuminated (in the step S550) if the selected feed opening is not empty.

TABLE 2

| Magnification | Document | | | | | |
|---|---|---|---|---|---|---|
| | A3 | B4 | A4 length-wise | B5 length-wise | A4 width-wise | B5 width-wise |
| × 1.414 | × | × | A3 | B4 | × | × |
| × 1.152 | × | A3 | B4 | A4 length-wise | × | A4 width wise |
| × 1.000 | A3 | B4 | A4 length-wise | B5 length-wise | A4 width-wise | B5 width-wise |
| × 0.865 | B4 | A4 length-wise | B5 length-wise | × | B5 width-wise | × |
| × 0.707 | A4 length-wise | B5 length-wise | × | × | × | × |

(d-4) Copy Operation

Figure 12A:
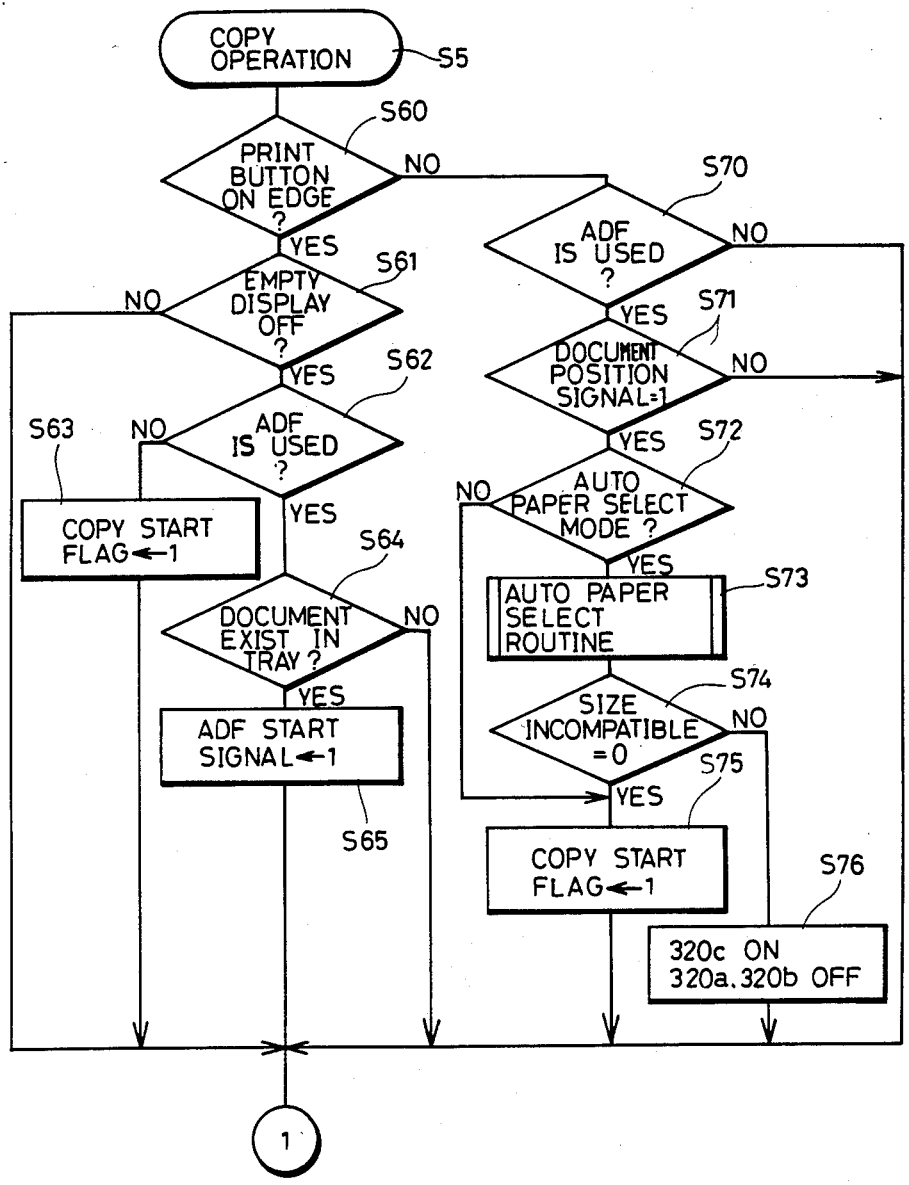
FIGS. 12A, 12B and 12C are flow charts of a subroutine of copy operation according to the present invention.
Figure 12B:
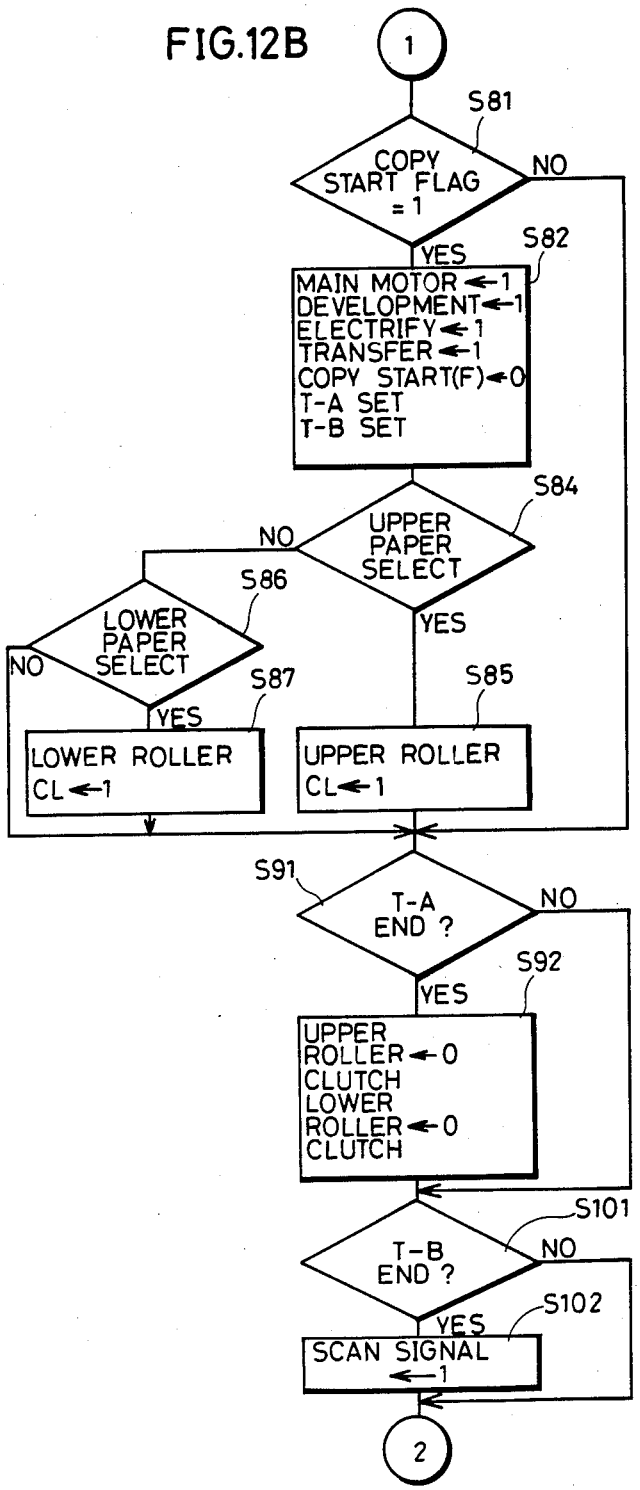
Figure 12C:
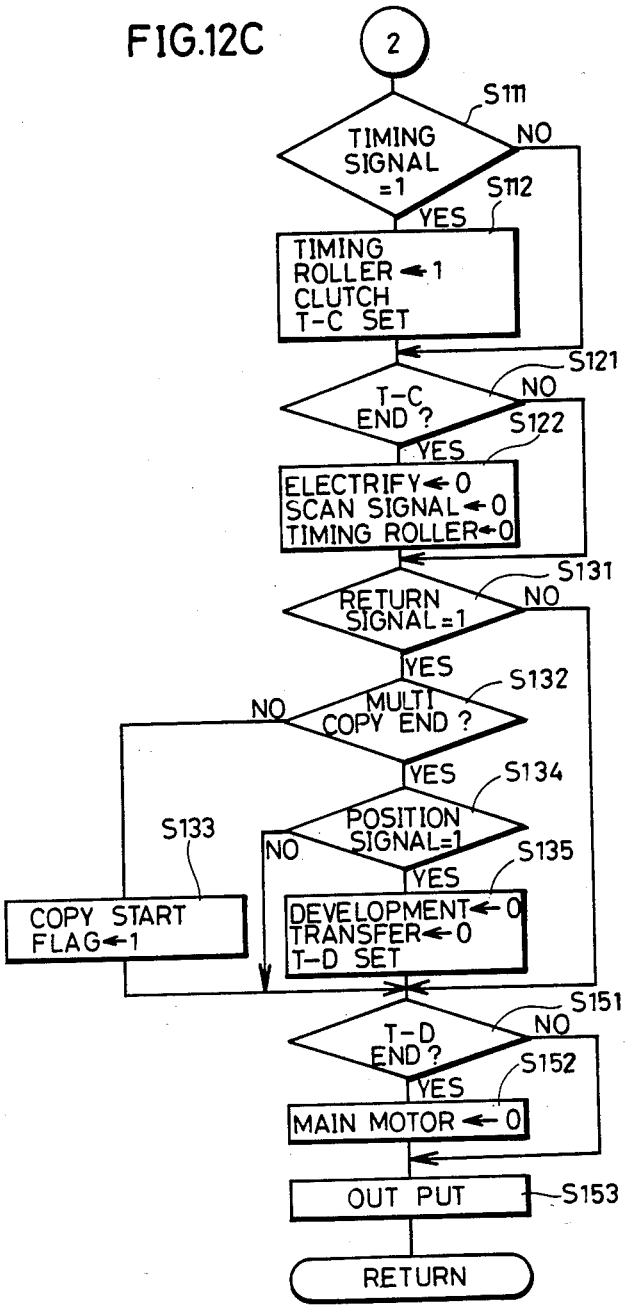

FIGS. 12A, 12B and 12C are flow charts of the copy operation routine S5.

First, at the ON edge of the print button 50 (in the step S60), if the empty display 52 is not illuminated (in the step S61) and if the automatic document feeder is not used (in the step S62), a copy start flag is set to "1" (in the S63). If the automatic document feeder is used (in the step S62), and if a document exists on the document tray 304 (in the step S64), an automatic document feeding start signal is set to "1" in connection with the document feeder unit 300 (in the step S65). On the other hand, if the empty display 52 is illuminated (in the step S61), the program directly proceeds to the subsequent routine.

With the timing not corresponding to the ON edge of the print button 50 (in the step S60), if the automatic document feeder is used (in the step S70), and if it is determined that the document position signal from the document feeding unit 300 is "1" (in the step S71) and that the mode of the automatic document feeder is the automatic paper selection mode (in the step S72), the automatic paper selection routine (in FIG. 13) is called (in the step S73). As a result, if a flag for indicating incompatibility of size is "0" (in the step S74), the copy start flag is set to "1" (in the step S75). If the flag for indicating incompatibility of size is "1", the display element 300*c* is illuminated and the display elements 320*a* and 320*b* are not illuminated. Then, the mode of the automatic document feeder is automatically changed to the manual mode (in the step S76). Since the manual mode is thus selected automatically, if one feels it troublesome to change paper, he may immediately press the print button 50 to start printing and, in such a case, a copy can be obtained although paper of the most suitable size is not used. In addition, if one wants to use paper of the most suitable size, he has only to manually set paper of the most suitable size.

The following copy operation is the same as in a conventional machine. When the copy start flag is "1" in the step S81, the main motor M1 and the development motor are turned on and the electrification charger, the transfer charger etc. are also turned on. Then, the copy start flag is set to "0" and the timers T-A and T-B are enabled to start measurement (in the step S82). If the upper paper feed cassette is selected (in the step S84), the upper feed roller clutch not shown is turned on (in the step S85). If the lower paper feed cassette is selected (in the step S86), the lower feed roller clutch not shown is turned on (in the step S87).

In the step S91, the state of the timer T-A is checked and when the timer T-A comes to an end, the upper and lower feed roller clutches are turned off (in the step S92).

In the step S101, the state of the timer T-B is checked. When the timer T-B comes to an end, a scanning signal is applied (in the step S102).

In the step S111, when the timing signal is "1", a timing roller clutch not shown is turned on and a timer T-C is enabled to start measuring (in the step S112).

In the step S121, when the timer T-C comes to an end, the scanning signal is stopped and the timing roller clutch as well as the electrification charger is turned off (in the step S122).

In the step S131, when a return signal of the optical system is "1", namely, when return is started, it is determined (in the step S132) whether the copy operation for a plural number of copies is completed or not. If it is not completed, the copy start flag is set to "1" (in the step S133). When the scanner which is temporarily moved away from the prescribed position returns to the prescribed position to cause the position sensor SW50 to be turned on (in the step S134), the development motor and the transfer charger are stopped and a timer T-D is enabled to start measurement (in the step S135).

When the timer T-D comes to an end (in the sep S151), the main motor M1 is stopped (in the step S152). Subsequently, the results of the processing performed so far are outputted (in the step S153).

(d-5) Automatic Paper Selection

Figure 13:
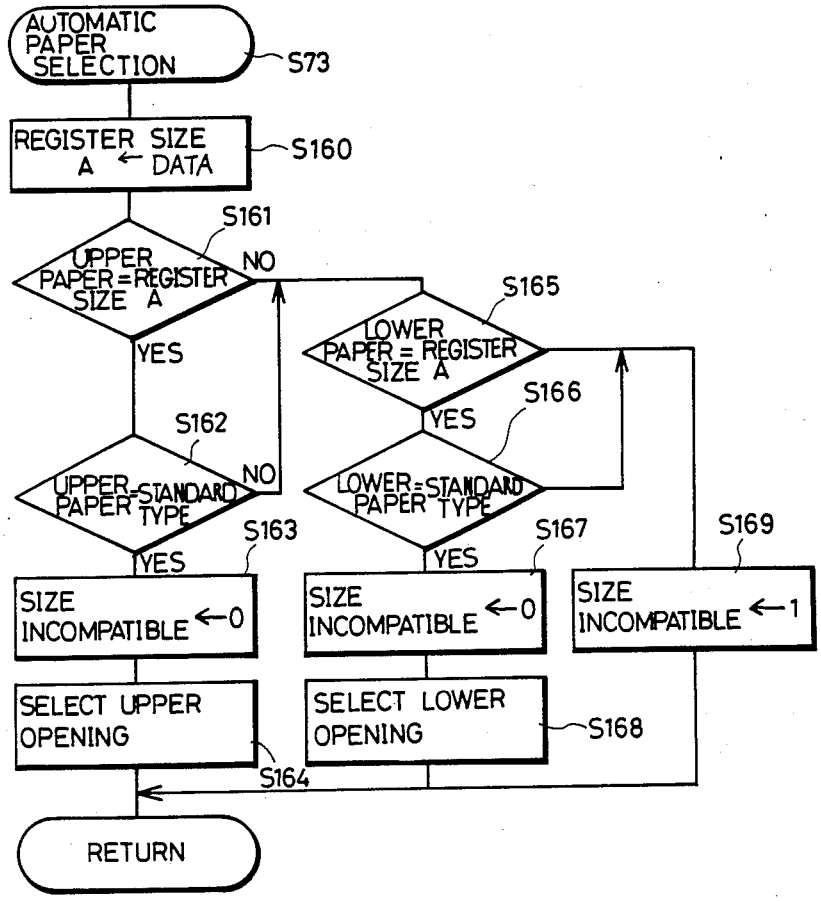
FIG. 13 is a flow chart of a subroutine of automatic paper selection.

FIG. 13 is a flow chart of the automatic paper selection routine S73. Document size data detected and transmitted by the microprocessor 203 controlling the document feeding unit 300 is temporarily stored in a register A (in the step S160).

Then, the document size data is compared with a paper size in the upper paper feed cassette 20 (in the step S161). If they are equal and the type of paper is the standard type, in other words, if the sensors 401 and 402 are both turned off (in the step S162), the flag indicating incompatibility of size is set to "0" (in the step S163) and the upper feed opening is selected (in the step S164). When the document size data is not equal to the paper size of cassette 20, the data is subsequently compared with a paper size in the lower paper feed cassette 21 (in the step S165). If they are equal and the type of paper is the standard type, in other words, if the sensors 401 and 402 are both turned off (in the step S166), the flag indicating incompatibility of size is set to "0" (in the step S167) and the lower feeding opening is selected (in the step S168). If the document size data is neither equal to the paper size in the first feed opening nor equal to that in the second feed opening, the flag indicating incompatibility of size is set to "1" (in the step S169).

(e) Operation of the Automatic Document Feeder

Figure 14A:
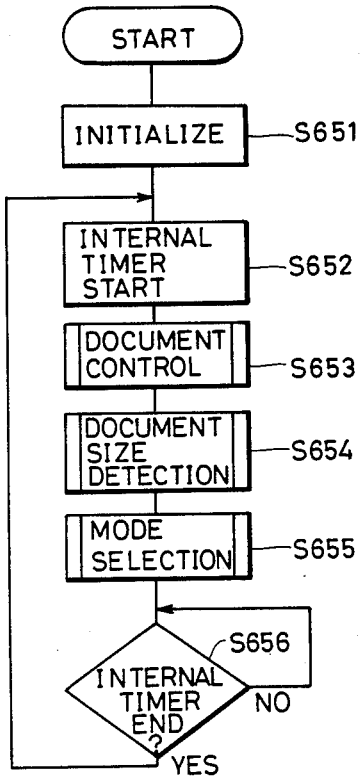
FIGS. 14A and 14B are flow charts showing a main routine of a program of a microprocessor 203 for controlling an automatic document feeder.
Figure 14B:
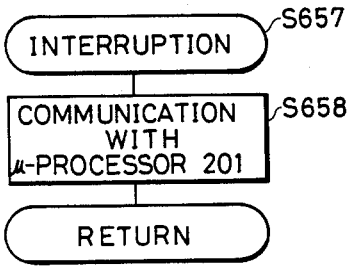

FIGS. 14A and 14B are flow charts of the main routine of the program in the microprocessor 203 for controlling the document feeding unit 300.

Referring first to FIGS. 14A and 14B, the program of the microprocessor 203 for controlling the document feeding unit 300 will be described.

When the microprocessor 203 is reset to start the program, the microprocessor 203 is initialized to clear the RAM and to set the registers and the copying machine is set to the initial mode (in the step S651).

Then, the internal timer contained in the microprocessor 203 ahd having a value preset by the initialization is enabled to start operation (in the step S652).

Subsequently, a subroutine of document control (in the step S653), a subroutine of document size detection (in the step S654) and a subroutine of mode selection (in the step S655) are called successively. When all the procedures of the subroutines are completed, the program waits for an end of the initially set internal timer and then one routine is completed (in the step S656). Using the time period of one routine as a unit length, the timers in the subroutines perform counting operation. (A count value of each timer corresponds to the number of occurrences of one routine, by which an end of measurement of each timer is determined.)

In addition, as shown in FIG. 14B, data communication (in the step S658) between the microprocessor 203 and the microprocessor 201 is conducted by an interruption routine based on a request for interruption (in the step S657) from the microprocessor 201, independent on the main routine.

Figure 15:
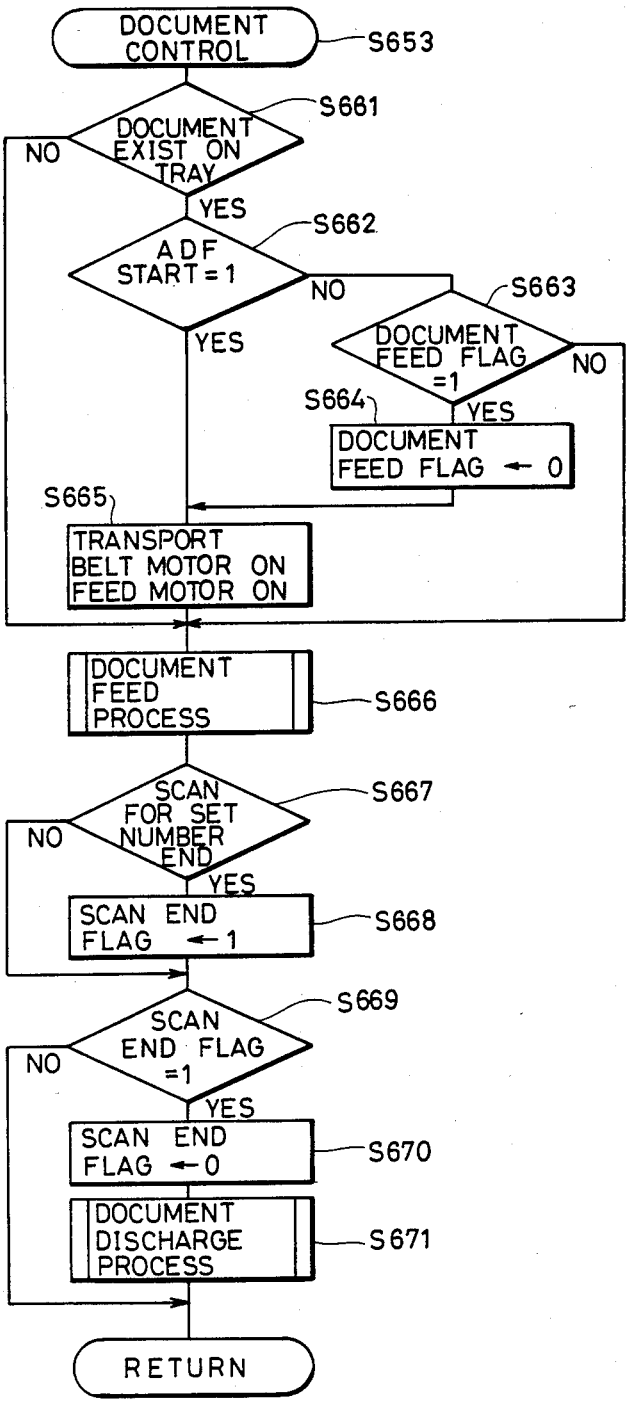
FIG. 15 is a flow chart showing a subroutine of document control.

FIG. 15 is a flow chart of the document control subroutine S653. When a document exists on a document tray the document detection sensor 311 is turned (in the step S661), and when the automatic document feeding start signal from tee microprocessor 201 is "1" (in the step S662), the transport belt motor 301 and the document feed motor 302 are turne on (in the step S665). On the other hand, when the document feed flag is "1" (in the step S663), the document feed flag is set to "0" (in the step S664) and, after that, the transport belt motor 301 and the document feed motor 302 are turned on (in the step S665).

Then, processing in a document feeding process routine is performed (in the step S666). When scanning for the set number of sheets comes to an end (in the step S667), the scanning end flag is set to "1" (in the step S668).

When the scanning end flag is "1" (in the step S669), the scanning end flag is set to "0" (in the step S670) and processing in the document discharge processing routine is performed (in the step S671).

Figure 16:
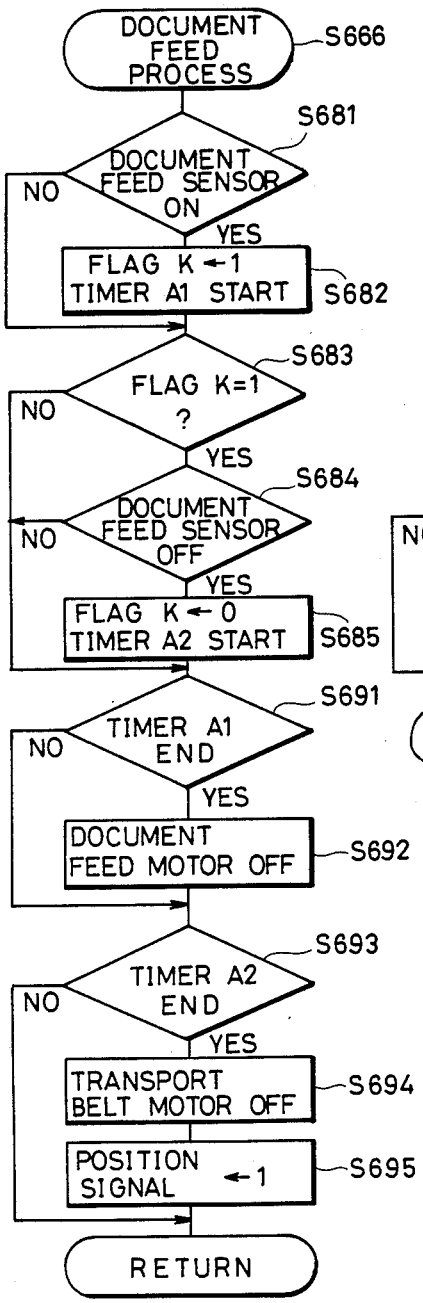
FIG. 16 is a flow chart showing a subroutine of document feeding processing.

FIG. 16 is a flow chart of the document feed process routine S666. When a document is fed to turn on the document feed sensor 310 (in the step S681), a flag K is set to "1" and a timer A1 is enabled to start measurement (in the step S682). This timer A1 is used to stop the document feed motor 302 so that the subsequent document may not be fed after feeding of the document concerned. A value corresponding to a period required for a document to attain a position causing it to be driven by the transport belt 305 is set in this timer.

Then, when the flag K is "1" (in the step S683), and if an OFF edge of the document feed sensor 310 comes, namely, if a trailing edge of a document is detected (in the step S684), the flag K is set to "0" and a timer A2 is enabled to start measurement (in the step S685). A set value of the timer A2 corresponds to a period required for the trailing edge of the document to attain a leading edge position on the douument glass table.

When the timer A1 comes to an end (in the step S691), the document feed motor 302 is stopped (in the step S692). When the timer A2 comes to an end (in the step S693), the transport belt motor 301 is stopped (in the step S694) and a document position signal is supplied to the microprocessor 201 (in the step S695).

Figure 17:
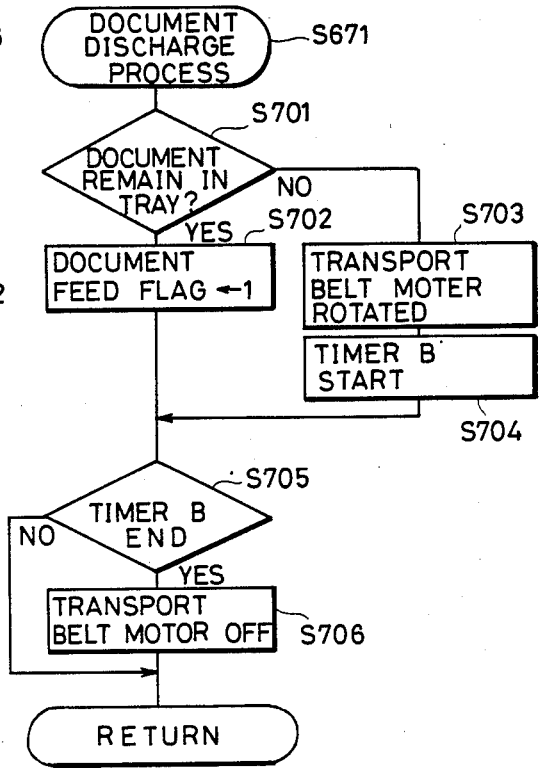
FIG. 17 is a flow chart showing a subroutine of document discharge processing.

FIG. 17 is a flow chart of the document discharge processing routine S671. When it is determined by the document detection sensor 311 (in the step S701) that the subsequent document still remains on the document tray, the document feed flag is set to "1" (in the step S702). If the document does not exist on the document tray, the transport belt motor 305 is rotated in a forward direction (in the step S703) and a timer B is enabled to start measurement (in the step S704). A set value of the timer B corresponds to a period required for the document (having the largest length) on the document glass table to be removed therefrom. When the timer B comes to an end (in the step S705), the transport belt motor 301 is turned off (in the step S706).

Figure 18:
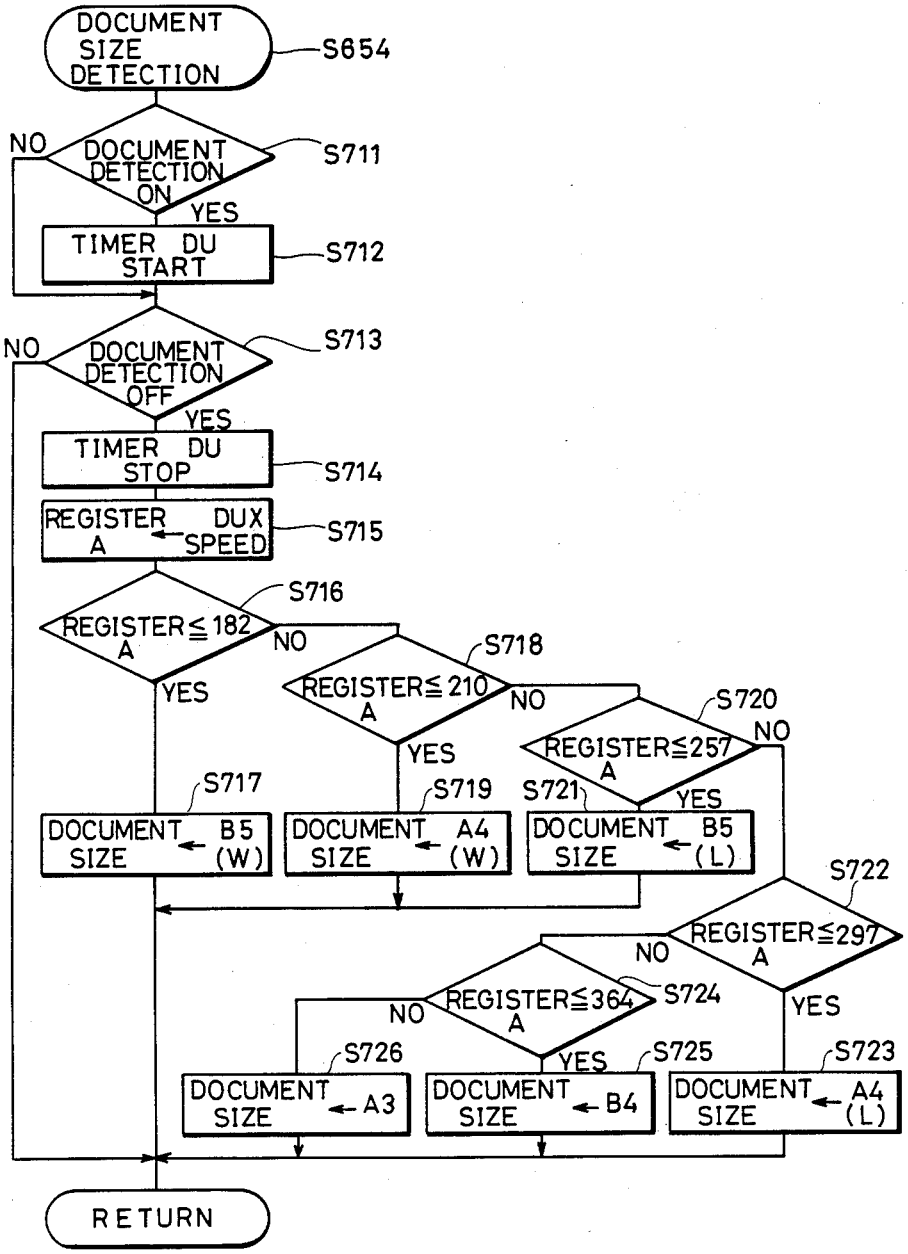
FIG. 18 is a flow chart showing a subroutine of document size detection.

FIG. 18 is a flow chart of the document size detection routine S654. At an ON edge of the document detection sensor 311 (in the step S711), a timer DU is enabled to start measurement (in the step S712). Then, at an OFF edge of the document detection sensor 311, namely, at the trailing edge of the document (in the step S713), the timer DU is stopped (in the step S714) and a product obtained by multiplication of the value of the timer DU at that time by the document transport speed, namely, the length of the document, is stored in the register A (in the step S715). If the value of the register A is 182 mm or less (in the step S716), it is determined that the document size is B5 widthwise (in the step S717). If it is 210 mm or less (in the step S718), it is determined that the document size is A4 widthwise (in the step S719). If it is 257 mm or less (in the step S720), it is determined that the document size is B5 lengthwise (in the step S721). If it is 297 mm or less (in the step S722), it is determined that the document size is A4 lengthwise (in the step S723). If it is 364 mm or less (in the step S724), it is determined that the document size is B4 (in the step S725). If it exceeds 364 mm, it is determined that the document size is A3 (in the step S726).

In order to precisely determine the document size, another sensor for determination of a document width may be provided adjacent to the sensor 310 so that turning on and off of the sensor may serve to determine sizes having different width values with the same length value (for example, A4 widthwise, A5 lengthwise etc.).

Figure 19:
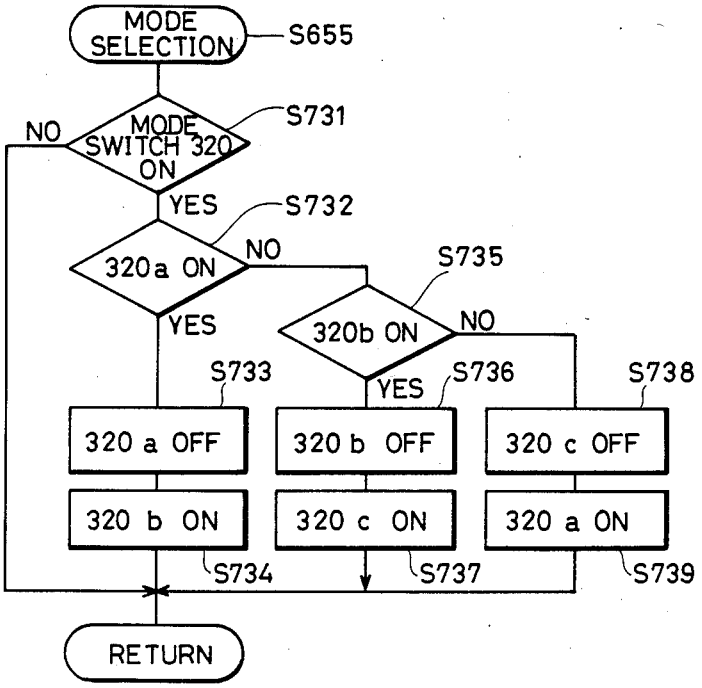
FIG. 19 is chart showing a subroutine of mode selection.

FIG. 19 is a flow chart of the mode selection routine (in the step S655). When the mode selection switch 320 is turned on (in the step S731), mode selection is performed in the following manner. If the LED display element 320*a* is illuminated at the ON edge of the switch 320 (in the step S732), which means that the automatic paper selection mode is selected, the mode is changed to the automatic magnification selection mode (in the steps S733 and S734); if the LED display element 320*b* is illuminated at the ON edge (in the step S735), which means that the automatic magnification selection mode is selected, the mode is changed to the manual mode (in the steps S736 and S737); and in the other cases, the mode is changed to the automatic paper selection mode (in the steps S738 and S739).

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying machine comprising:

means for forming an image of a document, a plurality of paper feed portions capable of containing paper of different sizes, first detection means for detecting a size of paper in each of said plurality of paper feed portions, second detection means for detecting existence of paper in each of said plurality of paper feed portions, means for manually selecting any of said plurality of paper feed portions, third detection means for detecting a size of the document, means for automatically selecting a paper feed portion containing paper of a size corresponding to the detected size of the document, means for selecting an automatic mode for performing copy operation by using said automatic selection means, means for manually inputting an instruction for starting operation of said image forming means, means for forbidding input of said instruction when paper does not exist in the paper feed portion selected by said manual selection means, and means for cancelling a forbidden state of said input forbidding means when said automatic mode is selected.

2. An electrophotographic copying machine in accordance with claim 1, further comprising:

means for forbidding copy operation in said automatic mode when paper of a size corresponding to the detected size of the document does not exist in any of said plurality of paper feed portions.

3. An electrophotographic copying machine in accordance with claim 1, wherein said image forming means comprises an automatic document feeder for feeding and setting the document to and at an exposure position and moving said document from said exposure position after exposure.

4. An electrophotographic copying machine in accordance with claim 3, wherein third detection means detects the size of the document when said automatic document feeder feeds the document to said exposure position.

5. An electrophotographic copying machine in accordance with claim 4, wherein said automatic document feeder starts feeding the document in response to input of the instruction by said instruction input means.

6. An electrophotographic copying machine in accordance with claim 5, wherein said means for forbidding copy operation interrupts copy operation in said automatic mode with the document being set at said exposure position by said automatic document feeder when paper of a size corresponding to the detected size of the document does not exist in any of said paper feed portions.

* * * * *